United States Patent [19]

Hung

[11] 4,372,255

[45] Feb. 8, 1983

[54] FIVE-SMOKE-FLUE TYPE WET WATER BOX BOILER

[76] Inventor: Chi C. Hung, No. 1246-6, Sec. 2, Wan Shou Rd., Kuei Shan Hsiang, Tao Yuan Hsien, Taiwan

[21] Appl. No.: 214,108

[22] Filed: Dec. 8, 1980

[51] Int. Cl.[3] ..... F22B 7/12

[52] U.S. Cl. ..... 122/149; 122/75

[58] Field of Search ..... 122/17, 52, 75, 81, 122/85, 149

[56] References Cited

U.S. PATENT DOCUMENTS

| | | | |
|---|---|---|---|
| 341,122 | 5/1886 | Adams | 122/52 |
| 2,548,287 | 4/1951 | Blake, Jr. | 122/75 |

*Primary Examiner*—Edward G. Favors

*Attorney, Agent, or Firm*—Armstrong, Nikaido, Marmelstein & Kubovcik

[57] ABSTRACT

The present invention relates to wet type water box boiler having five smoke-flues characterized by that the hot gas produced by the combustion is subject to twice of heat exchange with the water box in its route, thereby allowing an operating temperature of 1900° C. and enhancing the heat efficiency to 95%.

1 Claim, 3 Drawing Figures

FIVE-SMOKE-FLUE TYPE WET WATER BOX BOILER

BACKGROUND OF THIS INVENTION

The present invention relates to a smoke-flue system of wet water box boiler having five smoke flues.

Generally speaking, the boilers used nowadays fall into two categories. The first kind is designed as four-smoke-flue type without any attachment for absorbing heat in the first smoke-flue and the place the fire flaming, thus a large amount of available heat is thrown with the blaze to the fire bricks of the rear smoke box. This not only shortens the lives of these bricks, but also renders the failure of the boiler to make plentiful exploitation of the available heat to reduce the fuel consumption. As for the other kind, wet water box is provided for heat absorption for fuelsaving sake; nevertheless the heat efficiency is still unsatisfactory due to the less number of smoke flues. Notwithstanding the disadvantages of the latter, the former is gradually superseding the latter. In this regard, the trend of the development of boilers appears to be directed toward the increase in the number of smoke flues.

Accordingly it is the chief object of this invention to obviate or mitigate the drawbacks of these yet known smoke-flue devices.

SUMMARY

This invention relates to smoke-flue system, and more particularly, to one having an additional water box at the terminal end of the first smoke-flue of conventional 3-flue type boiler, and two extra flues, namely the 4th and 5th flue, to make the most exploitation of available heat, so as to enhance the heat efficiency to as high as 95%, in constrast with the 70–80% of conventional types. It can save as much as 40% of the fuel consumption of conventional boiler systems.

This invention has several advantages over the conventional smoke-flue boilers due to the following grounds.

(a) The additional flues elongate the length of the path which results in a higher drag, therefore properly raising the pressure to contribute to a corresponding higher temperature of combustion. Since the rate of heat transfer is a term of thermal gradient, the heat efficiency is thus considerably enhanced.

(b) The same number of steel pipes in three-smoke flue type boiler are distributed to five smoke flues. Apparently, the average sectional area of the path is reduced, and the flow rate is increased correspondingly, hence further enhancing the heat transfer.

(c) The boiler is provided with means to remove the accumulated oil automatically after every use, thereby ensure the apparatus always in good condition.

(d) The reasonable design of exhausting system by increasing the power of the draft fan of conventional three-smoke-flue type boilers by ¼ H.P. to overcomes the head loss in the path. Accordingly, the technological breakthrough of five-smoke flue design enables this invention to achieve 1.5 times of function of the conventional types with the same bulkiness, thereby allowing the apparatus to be scaled down to save the cost of the construction of the apparatus.

(e) The exhausted gas, measuring up to about 180° C. only, is almost of the same temperature as the boiler, contrasting with the 300°–400° C. of conventional types, hence reducing nearly 50% of the waste of available heat.

Additional objects of my invention will be brought out in the following description of a preferred embodiment of the same taken in conjunction with the accompanying drawings wherein:

DETAILED DESCRIPTION OF THE DISCLOSURE

Figure 1:
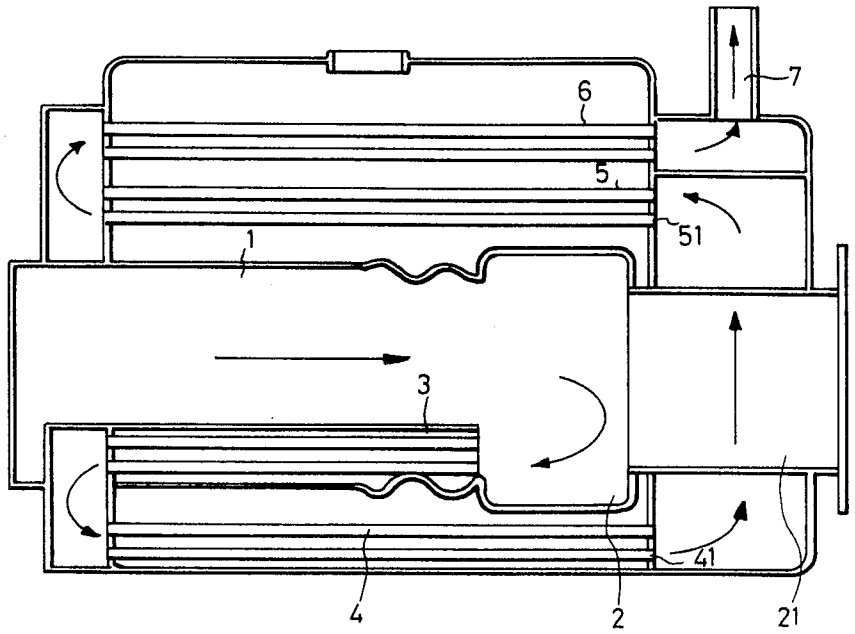
FIG. 1 is a longitudinal sectional view of this invention.
Figure 3:
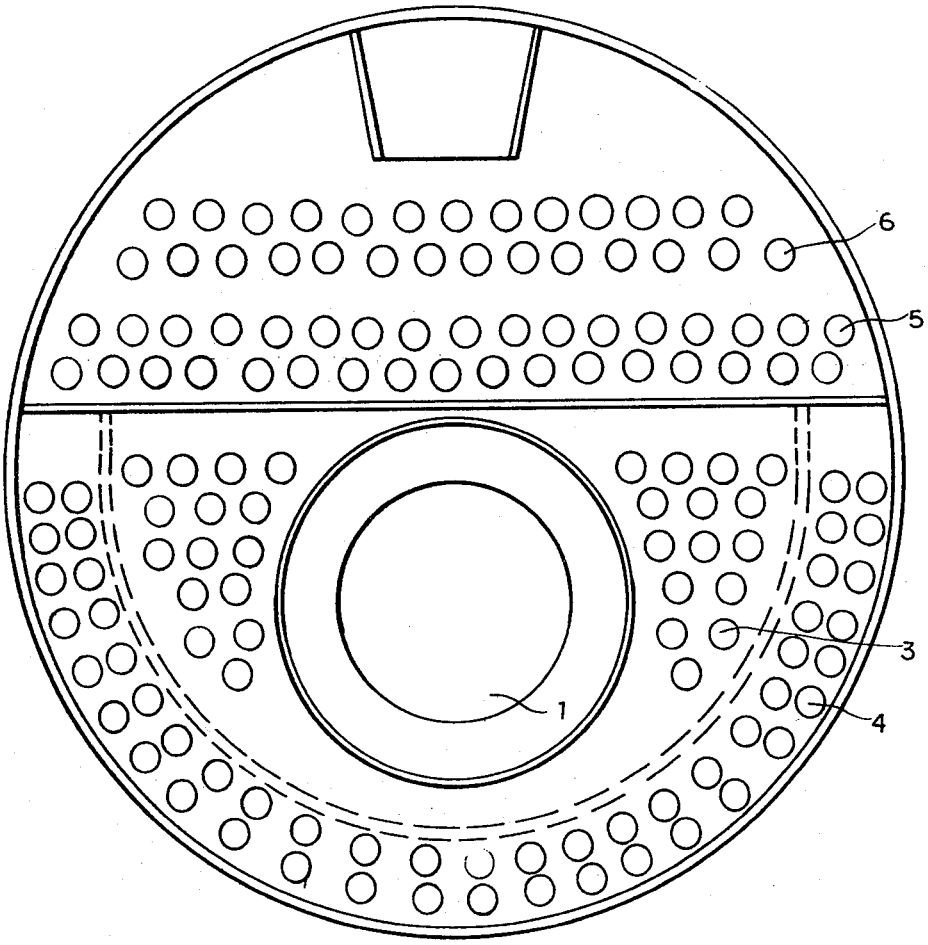
FIG. 3 is a transverse sectional view of this invention.

With reference now to FIG. 1, this invention comprises a five-smoke-flue path. At the end of first smoke-flue (1), there is disposed a wet-type heat-absorbing water box (2) which acts as the first heat absorber. Then the hot gas passes through the second smoke-flue (3) and enters the third smoke-flue (4), then leaves the terminal end (41) of the third smoke-flue (4) and pass around said water box (2) once more, thus being subject to another heat absorption. The hot gas pass through the entrance (51) of the fourth smoke-flue (5), and reach the fifth smoke-flue (6), and is finally exhausted form a chimney (7). With its twice heat absorption, the heat efficiency can be raised to 95%. The temperature in the furnace while the combustion is proceeding can rise to as high as 1900° C., which renders a sharp thermal difference with respect to the temperature of about 180° C. in the boiler. FIG. 3 shows the cross section of this invention.

Figure 2:
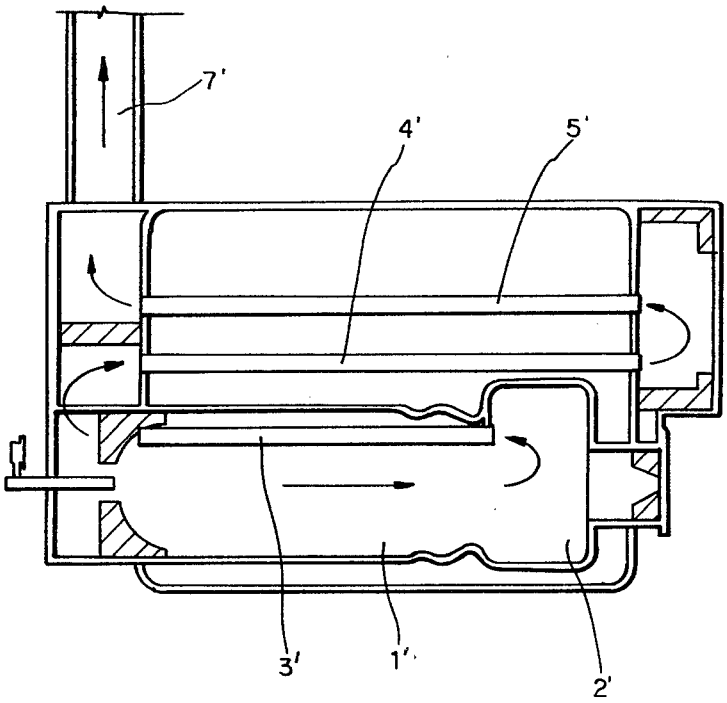
FIG. 2 is a sectional view of conventional 4-flue type boiler.

FIG. 2 exhibits a conventional 4-flue type boiler, wherein the primed, like reference numeral designates like, corresponding parts of that of the invention. When the hot gas passes through the first smoke-flue (1') and is subject to heat exchange with wet-type water box (2'). Then, sequentially, it enters the second flue (3'), third flue (4'), fourth flue (5'), and is ultimately exhausted through the chimney (7'). Such apparatus suffers several disadvantages except for its relatively low heat efficiency. Since when the hot gas flows into its first smoke-flue (1'), a countercurrent is formed when the same is flowing in reverse direction into the second smoke-flue (3'), thus resulting in the annoying extinguishment of the fire, or even worse, the hazard of instantaneous blast. Moreover the temperature of the exhausted gas measures up to above 200° C., which is physiologically unbearable to the workers, therefore the workers must keep away from the boiler a considerable distance, and this causes much inconvenience in operation.

It will be apparent from the foregoing description of my invention, that the same is subject to alteration and modifications without departing from the underlying principles involved, and I accordingly, do not desire to be limited to the specific details illustrated and described except as may be necessitated by the appended claims.

I claim:

1. A boiler comprising:

an axially-horizontal cylindrical shell charageable with water and having a central axis and two ends;

a first smoke flue of relatively large diameter extending from one end of said shell to a position nearer to the other end of the shell in parallel to said axis and directly receiving hot products of combustion;

a wet-type heat-absorbing water box adjacent said other end and within said shell being connected to said first smoke flue at said position nearer to said other end, said water box having an extension beyond said other end;

a second smoke flue comprising a plurality of fire tubes positioned in two bundles horizontally adjacent to and parallel to said first smoke flue and extending from a side of said water box nearest said one end to said one end;

a substantially semi-circular first return chamber at said one end for reversing direction of flow of the products of combustion from said second smoke flue;

a third smoke flue comprising a plurality of fire tubes substantially semi-circularly around and parallel to said first and second smoke flues extending from said first return chamber to said other end, said third smoke flue substantially semi-circularly surrounding said water box;

a second return chamber at said other end for reversing direction of flow of the products of combustion from said third smoke flue, said second return chamber surrounding said extension of said water box;

a fourth smoke flue comprising a plurality of fire tubes arranged above and parallel to said first, second and third smoke flues extending from said second return chamber to said one end;

a partially semi-circular third return chamber at said one end for reversing direction of flow of the products of combustion from said fourth smoke flue, the third return chamber having a shape that complements a shape of the first return chamber to match the cylindrical shape of the shell;

a fifth smoke flue comprising a plurality of fire tubes arranged above and parallel to said fourth smoke flue extending from said third return chamber to said other end; and a chimney connected to said fifth smoke flue at said other end of said shell;

the products of combustion being passable serially through said first smoke flue, said water box, said second, third, fourth and fifth smoke flues for heating water charged in said shell.

* * * * *